US005679913A

United States Patent [19]

Bruti et al.

[11] Patent Number: 5,679,913

[45] Date of Patent: Oct. 21, 1997

[54] ELECTRONIC APPARATUS FOR THE AUTOMATIC COMPOSITION AND REPRODUCTION OF MUSICAL DATA

[75] Inventors: Luigi Bruti, Pedaso; Nicola Calo', S. Benedetto del Tronto; Demetrio Cucco, Fermo, all of Italy

[73] Assignee: Roland Europe S.p.A., Picena, Italy

[21] Appl. No.: 689,062

[22] Filed: Jul. 30, 1996

[30] Foreign Application Priority Data

Feb. 13, 1996 [IT] Italy ..... MI96A0269

[51] Int. Cl.[6] ..... G10H 1/26; G10H 7/00

[52] U.S. Cl. ..... 84/609; 84/610; 84/634; 84/645

[58] Field of Search ..... 84/609–614, 634–638

[56] References Cited

U.S. PATENT DOCUMENTS 4,685,370 8/1987 Okuda et al. .
5,235,126 8/1993 Bruti et al. .
5,457,282 10/1995 Miyamoto et al. .

*Primary Examiner*—Stanley J. Witkowski
*Attorney, Agent, or Firm*—Young & Thompson

[57] ABSTRACT

An electronic apparatus for the automatic composition and reproduction of musical accompaniments and/or songs. The apparatus comprises a memory for storing a plurality of multi-track patterns containing musical data relating to songs and/or accompaniments of various styles; a selector is operable for controlling operational data tables on the basis of memorized program instructions, so as to select and read data of musical events on one or more data tracks, or parts thereof, in each of the selected pattern, as well as comprises operational program device for sequentially reading and composing the musical data contained in the data tracks of selected patterns, so as to make the number of musical measures and the temporal lengths of the selected data tracks uniform and to synchronize in real time the reading of data tracks having equal and/or different length, at points comprised in the real portion or in a virtual extension of each data track; the musical data of the tracks read in one pattern and the musical data of the tracks read in a successively selected pattern are therefore maintained in a musically consistent condition.

8 Claims, 6 Drawing Sheets

ELECTRONIC APPARATUS FOR THE AUTOMATIC COMPOSITION AND REPRODUCTION OF MUSICAL DATA

BACKGROUND OF THE INVENTION

The invention relates to an apparatus for the automatic composition and reproduction of musical data codified in digital form, by means of which it is possible to freely compose and reproduce arrangements of rhythmic and/or melodic parts of accompaniments and/or songs of various styles, using pre-programmed musical data which can be collected from any data source-inside and/or outside the apparatus, or which may be directly created by the same performer.

STATE OF THE ART

In an electronic musical instrument which uses an automatic recording apparatus (sequencer) able to record and reproduce data, the various musical pieces or "patterns" relating to "songs" and/or accompaniments of different musical "styles" are generally written and memorized on several parallel tracks to be subsequently reproduced in such a way that the performer is able to control them in an interactive manner and in real time. At the present time, both the sequencers able to record and reproduce "songs" and the arrangers by means of which it is possible to record and reproduce accompaniments in various musical styles, which can be combined together in a significant manner during the execution thereof, make use of a data recording and reproduction method based on multi-track systems, in which the lengths of the individual tracks must be identical to one another and be a whole multiple of a "bar" or of a same musical length.

Moreover, in the present-day systems, not only must the lengths of the individual tracks of a musical pattern (number of bars) be identical to one another, but also the "time signature" (4/4, 3/4, etc.) must be identical for the various tracks which make up the individual musical pieces relating to the various instrument groups for each data pattern to be recorded and/or reproduced. Therefore, with the known current systems, it is not possible to create songs and/or accompaniments of varying styles, collecting musical data from tracks of different length and/or with a different time signature or musical time since, in the case of an interactive control, it would not be possible to obtain a musically consistent synchronization between the tracks. Systems of this kind are described, for example, in U.S. Pat. No. 4,685,370 (Okuda et al).

From U.S. Pat. No. 5,457,282 (Miyamoto et al.) it is also known an automatic accompaniment apparatus, in which a plurality of original accompaniment patterns relating to different accompaniment styles, which are suitably pre-recorded, may be used to compose new patterns or new arrangements by collecting together the desired pattern parts which may be composed to create a new accompaniment pattern which differs from the original ones.

During the reproduction of the new pattern, pattern parts of different length and/or with a different time signature may be corrected to maintain a musically consistent progression, while the new accompaniment pattern is automatically played. This patent merely proposes a different system for composing accompaniment patterns, without providing the performer with any possibility of intervening dynamically, in an interactive manner, in order to select musical pieces or parts thereof from several groups of tracks of various available patterns, while playing, and modifying in real time the "style" of a song and/or an accompaniment, in terms of its rhythm and/or melody, while maintaining a synchronized and musically consistent performance.

OBJECTS OF THE INVENTION

The general object of the invention is to provide an electronic apparatus for the automatic composition and reproduction of musical data codified in digital form, by means of which the user is able to freely compose and reproduce pre-stored musical patterns or patterns provided on purpose by the same performer, using accompaniment patterns and/or songs with different styles which can be selected, combined and reproduced in real time, in a musically significant manner, while they are being performed automatically. For the purposes of the present description, the term "musical pattern" is understood as being the set of several musical phrases belonging to different instrument families, all of which have the same time signature and recorded or recordable on several parallel tracks having the same and/or different lengths, in which each phrase of each track consists of a succession of musical "events", for example notes, rests and/or other musical data which make up the specific phrase of an instrument family.

Another object of the invention is to provide an electronic apparatus for the automatic composition and reproduction of musical data, as previously referred to, by means of which it is also possible to use data patterns having tracks of different length and/or data patterns with different styles and/or musical time with refrain points for each track which can be memorized in a compacted form and repeatedly read over the entire length of the pattern or part thereof.

The apparatus according to the present invention therefore enables musical data to be collected from different sources and to be combined in a musically consistent manner, so as to give the performer the possibility of creating new songs and/or new styles by simply using tracks of musical data from pre-existing data libraries. At the same time it enables the time required for editing the musical data to be reduced substantially and offers the possibility of defining refrains for each musical track of the same length or of different length, thus allowing a substantial reduction in the musical data to be memorized and a consequent saving in the amount of the required memory.

Yet another object of the present invention is to provide an automatic accompaniment apparatus which may be separate or forms part of an electronic musical instrument.

As previously mentioned, in a traditional multi-track audio reproduction and/or recording system it is possible to have at one's disposal, located on the various tracks, different types of arrangement which evolve simultaneously and parallely with one another, providing the operator with the possibility of dynamically activating one or more tracks at the same time, as required, while keeping their synchronism unaltered.

In an electronic system managed by a CPU, however, it is extremely difficult, owing to the reduced processing capacity of the CPU, to manage simultaneously and in parallel the several patterns of musical data which represent the many variations in arrangement of a style and/or a song.

Unlike traditional systems, the invention therefore relates to an electronic apparatus in which the CPU manages a single pattern of musical data at a time, nevertheless providing the operator with the possibility of dynamically activating reading of the many variations in arrangement which are made disposable, ensuring always synchronization and sequential execution in a musically correlated manner.

According to a first aspect of the invention, an electronic apparatus for the composition and the reproduction of musical data is provided, said apparatus comprising:

first read-only memory means (ROM) for memorizing a plurality of basic patterns of musical data, in which each basic pattern comprises a set of parallel tracks of musical data relating to different accompaniment styles and/or songs of the same or of different lengths;

second read-and-write memory means (RAM); and data pattern control and selection means for selecting and reading the musical data of one or more data tracks in each basic pattern recorded in said first memory means (ROM) and for transferring the musical data of the basic patterns selected from said first memory means (ROM) to said second memory means (RAM);

as well as program means (CPU) comprising program instructions for sequentially composing and reading the musical data read from different basic patterns subsequently selected in said memory means, said program means (CPU) for composing and reading the musical data from the selected basic patterns comprising control means operative during reading of the data, to make the number of musical measures and the temporal length of the data tracks of shorter length uniform with that of the longer data track in each basic pattern, and means (ALU) for synchronizing reading of the selected data patterns, to initiate, in real time, reading of tracks of equal and/or different lengths of a data pattern, from a point comprised in a real part or in a virtual extension of tracks of equal and/or different length for each selected pattern, maintaining a musically consistent condition for the musical data read in each selected pattern and musical data read in a pattern selected subsequently.

According to a specific embodiment of the apparatus, the first memory means comprise a plurality of musical patterns relating to a multiplicity of variations for arrangement of different styles and/or songs at the performer's disposal, which are memorized in two pattern groups, one group of which comprises a first set of loop pattern divisions, in which the musical data relating to a cyclically repeatable succession of musical events, also referred to as a succession of "basic events" are memorized once only or in a "compacted" form in their track so as to be read and cyclically reproduced, and in which the other group of patterns comprises a second set of "one-shot" pattern divisions formed by a non-cyclical succession of musical events which are memorized in their total extension and which are read and played only once; and in which each pattern division in turn comprises different musical modes, for example "major", "minor" and "seventh", each composed for example of eight tracks of equal and/or different length containing data of musical events relating to the various associated instrument families.

According to a further feature of the invention, the data pattern control and selection means comprise a selecting device for selecting the addressed of the musical data patterns and a pointer unit for reading, in each track, all the data and the codified musical information, called "events" relating to the various time intervals between each event and the associated durations which can be quantified as a number of "timing" or counting pulses, also called "clock" pulses (CPT) of the musical data memorized in said first and/or second memory means. This reading is performed on the basis of information supplied by the pattern selection device and on the basis of information received at a MIDI IN serial port; in accordance with an instruction for program data memorized in a zone of the ROM memory and on the basis of the count of a number of timing (clock) signals indicative of the distance between adjacent musical events and the distance of the event from the next musical bar, in each track, so as to command the repeated reading of said cyclical data patterns and add musical rests in said non-cyclical data patterns, in comparison with the longest track in each pattern, as well as on the basis of a calculation of the number of clock signals to be counted for synchronization of reading of the data tracks of different patterns subsequently read.

According to a further feature of the apparatus according to the invention, the musical data pattern reading unit can be connected to musical tone generating means via a MIDI OUT serial port, to automatically reproduce a song and/or a musical accompaniment for example on the basis of information supplied by an apparatus for recognizing the chords played on a musical keyboard, described for example in U.S. Pat. No. 5,235,126 assigned to Roland.

According to a preferred embodiment, the means for synchronizing reading of the selected data patterns comprise an arithmetic calculating-unit (ALU) in a CPU programmed to perform division of the number of clock signals which have lapsed from the start of reading of a musical track, by the number of clock signals contained in the bar or musical measure of the selected data pattern, assigning the value of the remainder of this division as the input of a counter unit for indicating the number of clock signals to be skipped in order to synchronize a currently reading pattern with reading of a data pattern subsequently selected, so that execution of the new selected pattern is performed from the point which the said pattern would have reached if it had been read simultaneously and in parallel with the current pattern.

BRIEF DESCRIPTION OF THE DRAWINGS

The electronic apparatus for the composition and reproduction of musical data according to the invention and its operating mode will be described in greater detail hereinbelow, with reference to a preferred embodiment thereof and the accompanying drawings, in which.

DETAILED DESCRIPTION OF THE INVENTION

The general features of the electronic apparatus for the composition and reproduction of musical data according to the invention will be now described by making reference to the figures of the accompanying drawings.

Figure 1:
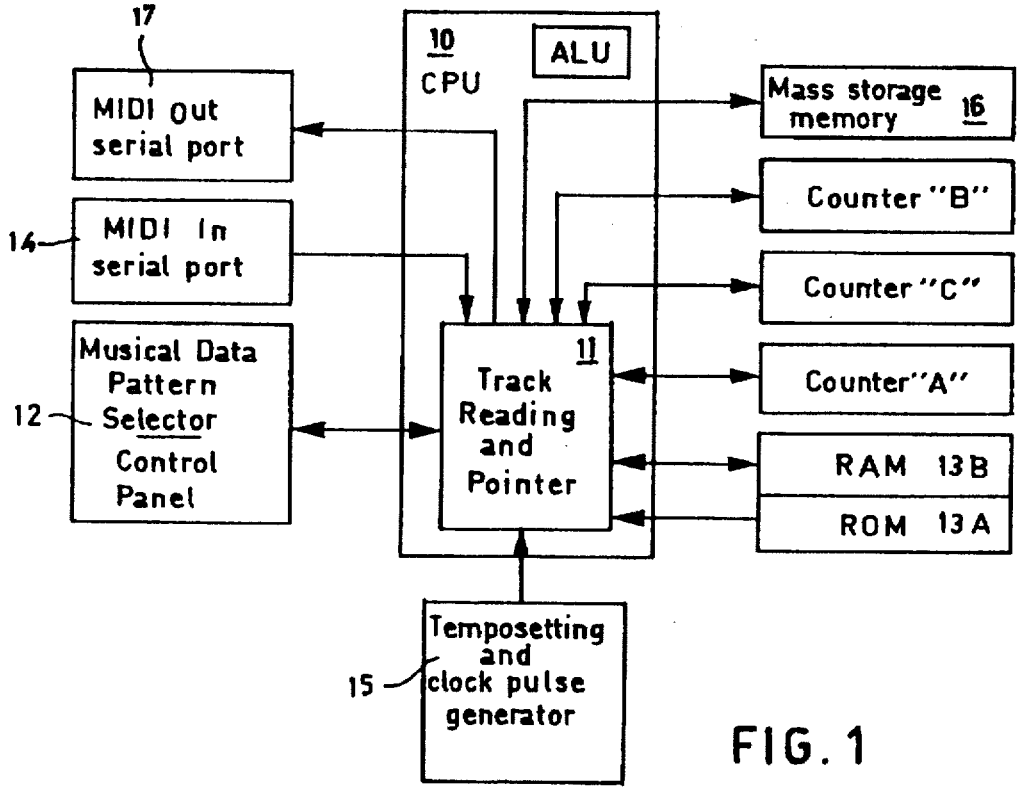
FIG. 1 is a block diagram which shows in schematic form the electronic apparatus for the composition of musical data according to the invention.

As shown in FIG. 1, the apparatus comprises several functional blocks connected together by a data processing and control unit 10, such as a CPU, comprising an arithmetic logic calculating unit ALU and a block 11 which performs reading of data and information contained in the other functional blocks of the apparatus.

In addition to the reading and pointer block 11, the apparatus comprises a block 12 for selecting the patterns of the musical data contained in a first ROM 02 read only memory 13A, which can be transferred into a second RAM 02 random access memory 13B; the pattern selection block 12 comprises moreover a control panel provided with switch circuits necessary for activating the various functions and for selecting the various parameter values, as well as a system for displaying the selected data.

The various musical data patterns stored in the memories 13A and 13B can in each case be read also through the control of a serial port MIDI IN 14 which is able to receive, via Standard MIDI protocol, musical data made available by external sources or control devices, such as for example a musical keyboard, a floppy disk or other musical data generating means.

Figure 2A:
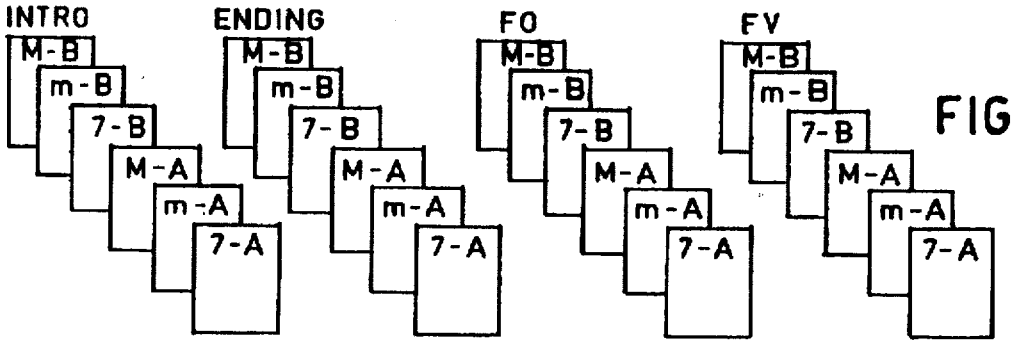
FIG. 2A is a schematic illustration of the group of data patterns read in a non-cyclical mode (one shot)
Figure 2B:
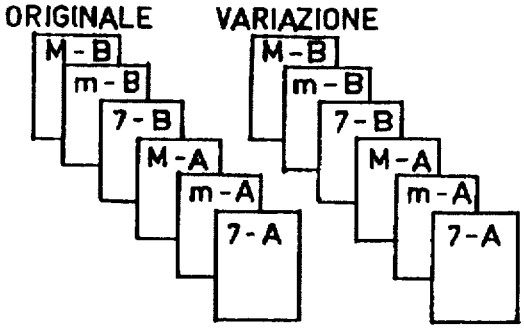
FIG. 2B is a schematic illustration of the group of data patterns read in cyclical mode (loop)

The ROM memory 13A in turn contains, in separate storing areas, a plurality of pre-memorized musical data patterns which are suitably subdivided for example in accordance with the diagrams shown in FIGS. 2A and 2B as well as the instructions and the program data for operation of the entire apparatus.

Reference 15 in FIG. 1 shows a functional block containing a timing or clock signal generator, the frequency of which can be adjusted via a suitable potentiometer, by means of which it is possible to set the "Tempo", i.e. the speed at which the variously selected musical pieces are played. Reference 16 in FIG. 1 shows also a mass storage memory of the apparatus.

The apparatus comprises moreover several counters for counting the clock pulses emitted by the generator of the block 15, which are intended to perform various functions; more precisely it comprises a counter C, for each pattern track, which counts the clock pulses used to determine the distance between two successive musical events on a same track; this counter in practice, at the speed set by the clock signals generated by the block 15, decreases or decrements the value of the number of the clock or CPT signals of the data patterns contained in the memories 13A, 13B read by the reading block 11 when the decremental or counting down reaches the value zero; the reading block 11, on the basis of the program data instruction, by its pointer reads the next event contained in the same track of the current pattern. The apparatus furthermore comprises a counter B for counting the clock pulses used to determine the distance of the musical event read first in a bar, from the start point of the next musical bar; in practice the counter B decreases the value of the number of clock pulses (CPT) set as from the value of the timing or clock pulses (CPT) for the individual musical bar, at the speed set by the block 15, i.e. the number of clock pulses (CPT) which separate the last event read by the reading block 11, from the start of the next bar. Finally, the apparatus comprises a third counter A is provided for counting the clock pulses used for synchronizing the readings of the various data patterns which are dynamically selected.

A serial port MIDI OUT 17 may be connected to an external musical tone generator for converting into musical sounds various events of the data patterns read from the memories 13A and/or 13B.

With reference now to FIGS. 2A to 6, we shall describe the procedures for memorizing and reading the data contained in the individual patterns of the memories 13A and 13B.

As is known, there are substantially two ways of creating new styles, i.e. creating them from new or editing existing styles by altering or modifying the setting of musical data or the required notes. In both cases, according to the present invention, it is possible to reduce to a minimum the programming time since the apparatus, although managing via the CPU a single data pattern at a time, nevertheless allows the operator to memorize only the main parts of each pattern and to entirely read each individual track or only a part thereof, by dynamically activating, in real time, the reading of the variations in available arrangement, ensuring that the transition of the execution from one musical pattern to the pattern selected next is always performed from a "real" or "virtual" point which the next selected pattern has reached or would have theoretically reached if it had been written in full and read simultaneously and in parallel with the current one.

More precisely, as shown in FIGS. 2A and 2B, the various musical patterns which represent the many arrangement variations of styles and/or songs available, are represented by various patterns which can be grouped into two main categories, referred to as "divisions" which comprise a first group of patterns performed only once also called "one shot patterns", and a second group of patterns performed cyclically, also called "looped patterns". Within each category of patterns further subdivisions, identifying specific musical applications thereof, are made possible.

For example, in the case shown in FIG. 2A, the non-cyclical or one-shot pattern category is divided up into four divisions, i.e. a first "Intro" division and a second "Ending" division which are establishing the beginning and the end of a musical piece or composition, as well as the FO (Fill in to Original) and FV (Fill in to Variation) divisions which indicate the start of new musical parts of an original pattern or a variation thereof.

On the other hand the looped pattern category is divided up into two basic divisions, called "Original" and "Variation", as shown in FIG. 2B. Each division of both the categories, in turn, may be composed of two types of pattern arrangements called "Basic" and "Advanced". Moreover, each type of pattern has moreover three harmonization "modes", typically called "Major mode" (M), "Minor mode" (m) and "seventh" (7). Overall, therefore, there are thirty six patterns or divisions which are differing for the style, each of which can be selected by dedicated keys, on the panel of the control block 12 and showing the corresponding wording, or by data supplied by an apparatus external to the MIDI IN serial port.

Figure 3A:
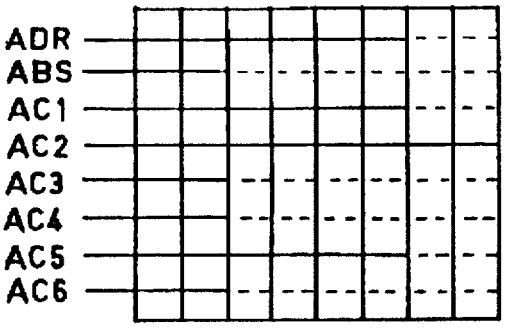
FIG. 3A shows in detail a pattern read in a non-cyclical mode.
Figure 3B:
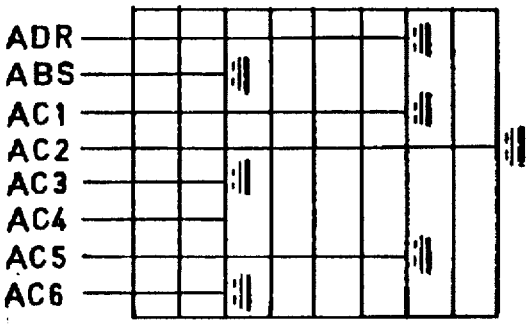
FIG. 3B shows in detail a pattern read in a cyclical mode.

Each pattern of musical data, as already mentioned, is finally divided up into several parallel "tracks", each track containing a set of musical data and/or information, said "events" which may be classified into various associated instrument families; an example is shown in FIGS. 3A and 3B, both for the tables read in a one-shot mode (Intro, Ending, FO, FV) and for the tables read in a looped mode (Original and Variation). As shown, in general there are eights tracks per pattern, indicated by ADR for the drum or percussion accompaniment; ABS for the bass accompaniment; and AC1, AC2, AC3, AC4, AC5 and AC6 for the different melodic accompaniments which can be selected by the operator.

Each track which composes a mode, of a type, of a division, of a style or song, may have a typical musical length, equal to or different from that of the other tracks. In FIG. 3A the lines in bold indicate the real length of each individual track, expressed in musical measures or bars, while the broken lines represent the added rests which, in this case, are calculated depending on the longest track of the tracks of a same data pattern.

Correspondingly, in the looped pattern of FIG. 3B, the lines in bold indicate, again in musical measures or bars, the real length of the tracks, while the symbol shown at the end of each track represents the real or virtual loop point, from where each track of the pattern is automatically re-read from the start, in an entirely independent manner from the other tracks of the same pattern, until reading of the longest track is terminated.

Reading of the individual data patterns by the reading and pointer block 11 indicated in FIG. 1 differs according to the associated category, i.e. depending on whether it is a pattern which can be read non-cyclically (one shot pattern) or cyclically (looped pattern).

Figure 4:
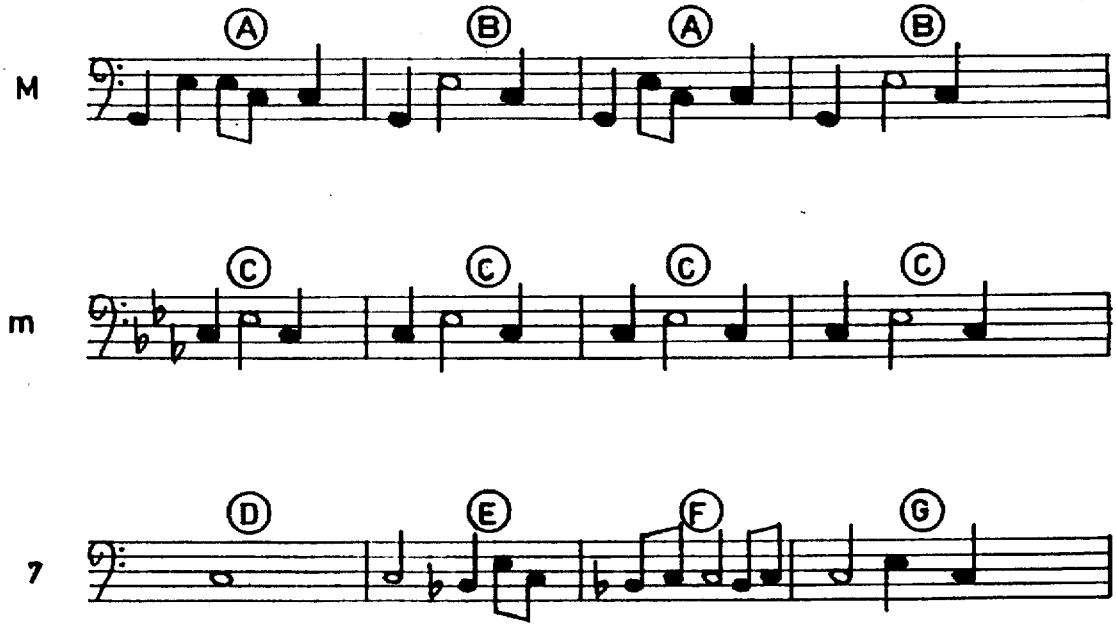
FIG. 4 is a musical example showing three typical configurations of a bass instrument for the creation of a composition, in which musical configurations of different types belonging to different patterns extend over four bars.

The above will be clarified in more detail hereinbelow with reference to the musical example of FIG. 4 showing three musical configurations, typical of bass instruments, which are memorized in different patterns for the creation of a new track of a musical data pattern in accordance with the operating mode of the apparatus according to the invention.

The musical configurations for the track of type M, m and 7 consist of an extension of four musical bars.

In particular, in the M type track there is a basic musical phrase composed of the succession of two different musical bars A and B which are repeated several times on the same track; on the other hand, in the m type track there is a repetitive succession of musical bars of the same type C which, in certain cases, could also be a sub-multiple of a bar or a simple event.

Finally, on the seventh type track there are four musical bars of different types D, E, F and G which complete the track.

In order to save memory space and reduce the time required for creating the musical composition and for entering the musical data in the memory, compaction or reduction of the length of the tracks of the M and m musical patterns of the looped type is performed, without altering the musical significance thereof, also to the advantage of a greater flexibility of composition during the manipulation stages which are typical of a collage. This is performed by memorizing only the two basic bars A and B of the M type track as well as the single basic bar C for the m type track; on the other hand, the four bars D, E, F and G of the one-shot or seventh type track are memorized subsequently in their entirety; in practice the M type track is compacted, i.e. is reduced to the extension of two cyclically repeatable measures, the m type track is reduced or compacted to the extension of a single measure, again cyclically repeatable, while the seventh type track, which cannot be compacted, it remains over the entire extension of four bars.

Figure 5:
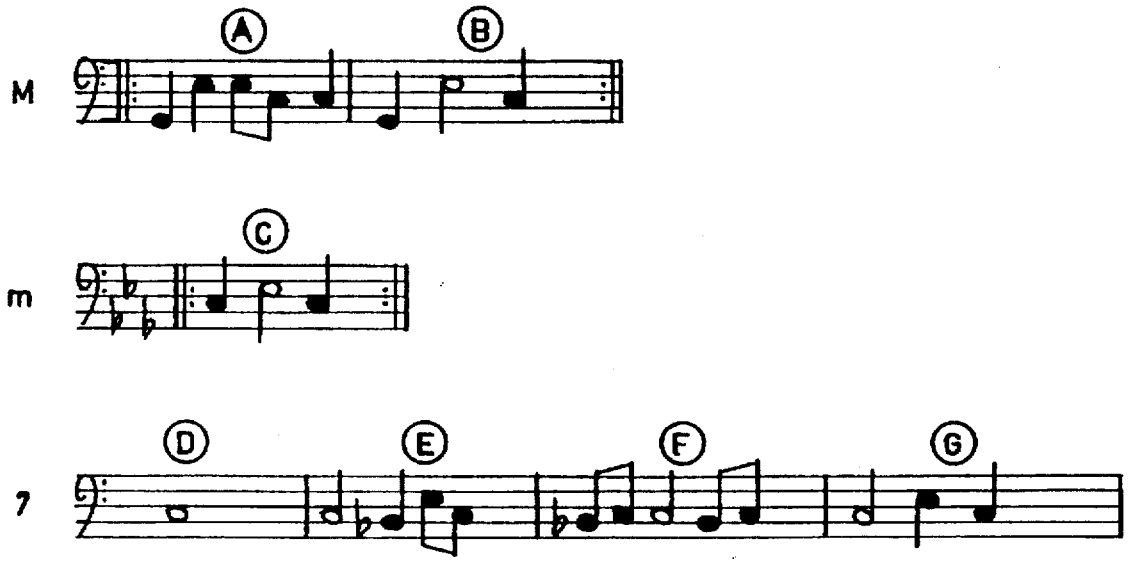
FIG. 5 shows how the three configurations of FIG. 4 can be musically compacted or reduced to a basic configuration.
Figure 6:
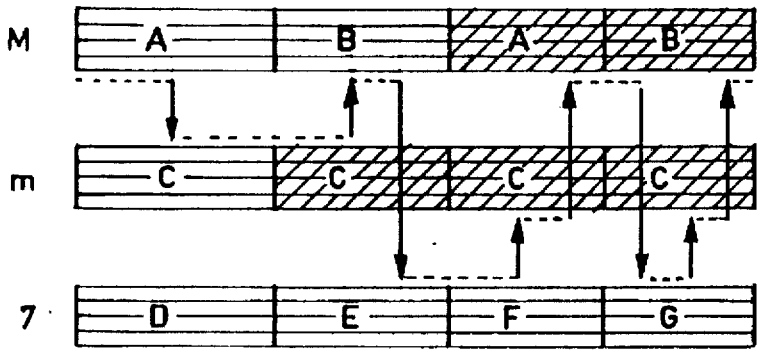
FIG. 6 shows how it is possible to perform a composition of musical data passing from a basic configuration of one pattern to another configuration of a pattern subsequently selected, using basic configurations memorized in a compacted form according to the example of FIG. 5, while maintaining a musically consistent condition.

Again with reference to the musical example of the preceding FIGS. 4 and 5 and the subsequent FIG. 6, a description will now be given as to how it is possible to pass in a synchronized manner from a track to another one, whether it be from a position in the real section shown unshaded in FIG. 6 or in a virtual extension necessary for completing the missing measures or bars, in order to obtain theoretically identical track lengths, as shown by the broken lines in the same FIG. 6.

As previously mentioned, the CPU is able to manage a single data pattern at a time; however, according to the present invention, the apparatus is programmed so as to give the operator the possibility, nevertheless, of dynamically activating reading of the available arrangement variations, while reading of a pattern is in progress, ensuring that the transition of the execution from the current pattern to the next selected one occurs in real time from a point contained in the real or virtual extension of the track of the pattern i.e., in the case of the virtual extension, from a point which the said pattern track would have reached if it had been entirely written or not compacted or reduced, existing for the entire natural duration.

Figure 7:
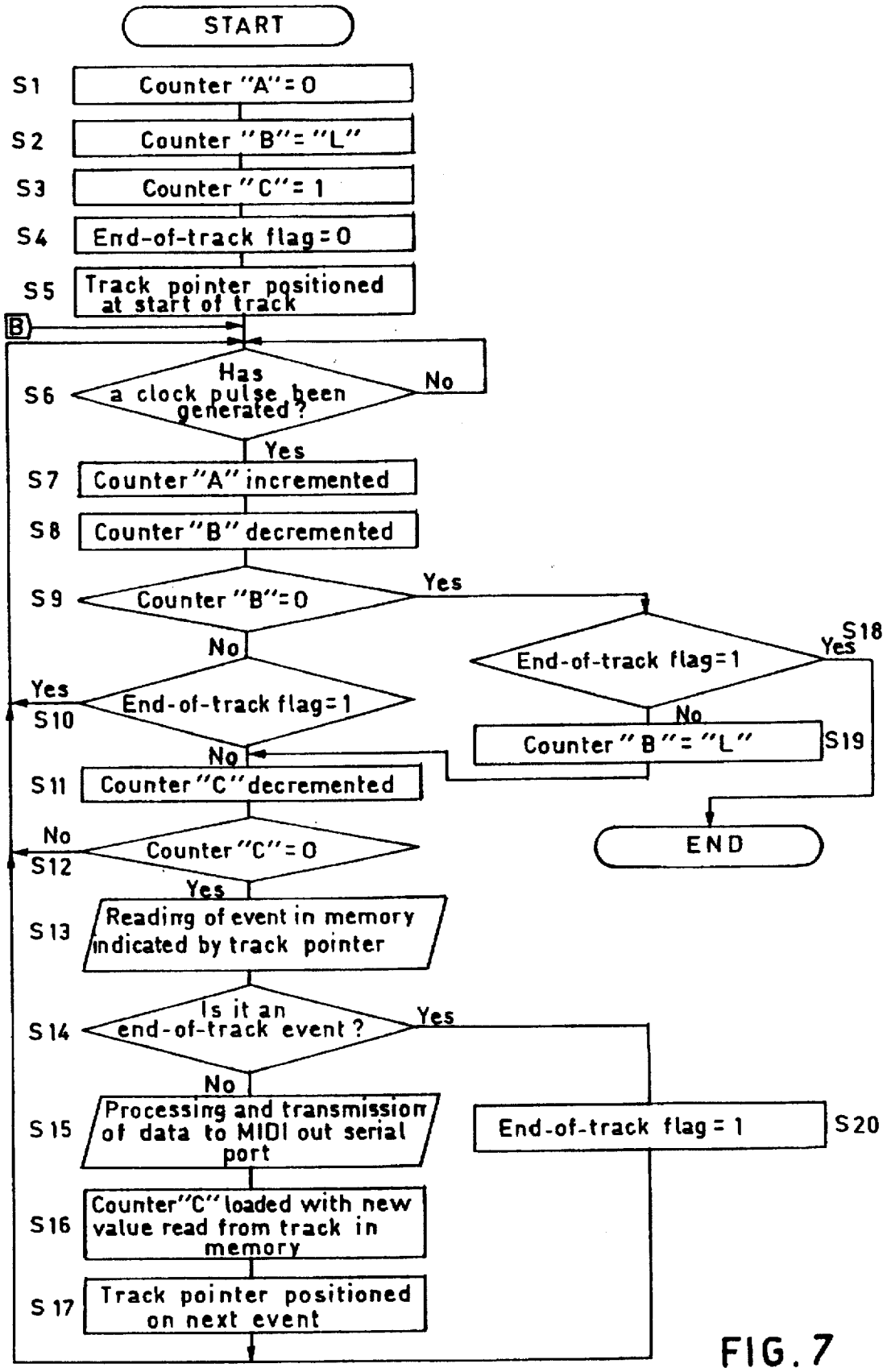
FIG. 7 is a flowchart illustrating the method of operation of the apparatus according to the invention, for reading a track of a musical pattern in a non-cyclical mode (one shot)

This is clarified more fully in FIG. 6 which shows how it is possible to effect a transition from a track of one pattern to a track of another pattern, obtaining a path of the type A(M)-C(m)-C(m)-B(M)-E(7)-F(7)-C(m)-A(M)-B(M)-G(7)-C(m)-B(M), where the hatched zones indicate the missing track parts, since compacted or reduced, as previously described with reference to FIGS. 4 and 5. The transition from one track to another at the points indicated by the arrows is performed under the control of the synchronization counter A, on the basis of the data supplied by the calculating unit ALU, as can be seen from the following flowcharts. With reference to FIG. 7, the operating mode of the apparatus on the basis of the flowchart illustrating reading of a track of a one-shot pattern will be firstly described.

At the start, after activating the switch for start-up of the procedure, provided on the special control panel of the selection block 12, the CPU initializes the various counters, in particular the synchronization counter A with the value 0 (step S1), the counter B with the value "L" of the clock pulses contained in a musical bar used for calculating the distance of an event from the next musical bar (step S2), and the counters C of the clock pulses used for determining, in each individual track, the distance between two successive musical events, with the value 1 (step S3); with the first decrement of the counter C (step S11), the reading block 11 of the CPU reads the first event in a specific track of a pattern selected from the ROM memory 13B and/or from the RAM memory 13A via the control panel 12 of FIG. 1 depending on whether a pre-memorized (ROM) or composed (RAM) pattern is to be performed. The track-end flag is moreover set to 0 (step S4) in order to indicate that the track-end event has not yet been read by the block 11 of the CPU.

The pointer contained in the reading block 11 provides in succession the reading data of the various musical events of each track of a pattern and it is therefore automatically positioned on the first event of the track of the selected pattern (step S5). At this point the CPU waits for a clock signal (CPT) generated by the timing pulse generating block 15 (step S6) with which the reading speed has also been set.

Once the timing signal (CPT) has been received, the CPU increments by one the synchronization counter A (step S7) in order to indicate that a time equal to one clock pulse (CPT) has lapsed and at the same time decrements by one the counter B (step S8) in order to indicate that the distance from the next bar is correspondingly diminished by one clock pulse (CPT).

If the counter B has reached "0" (step S9) and if the track-end event has already been read for each of the tracks which make up the pattern (step S18), reading of the non-cyclical or one-shot pattern is also terminated.

If the track-end event has not been read for each of the tracks which make up the pattern (step S18), the counter B is reset to the initial value L (step S19).

On the other hand, if the counter B has not reached "0" (step S9) and if the track-end event has already been read for each of the tracks which make up the pattern (step S10), the reading block 11 reads no further events, thus inserting musical rests for each track until the start signal of the next bar; in this way the end of execution of the non-cyclical pattern is determined.

On the other hand, if the counter B has not reached "0" (step S9) and if the track-end event has not been read for each of the tracks which make up the pattern (step S10), the CPU decrements by one the counter C (step S11) and, only when the value "0" is reached (step S12), does the reading block 11 read the event which has been subsequently indicated by the pattern track pointer (step S13).

If the read event is a track-end event (step S14), the track-end flag is set to 1 (step S20) so as to insert a musical rest until the next bar start signal following the readings of the track-end event of the longest tracks; in this way execution of the non-cyclical pattern is terminated.

On the other hand, if the event read is not a track-end event, the CPU processes and sends it, via standard MIDI protocol, to the MIDI OUT serial port 17 (step S15); the time value contained in the event read, indicating the number of clock or timing pulses (CPT) which separate it from the next event, is now entered in the counter C (step S16). At this point the track pointer is positioned on the event following the one read (step S17).

Figure 8:
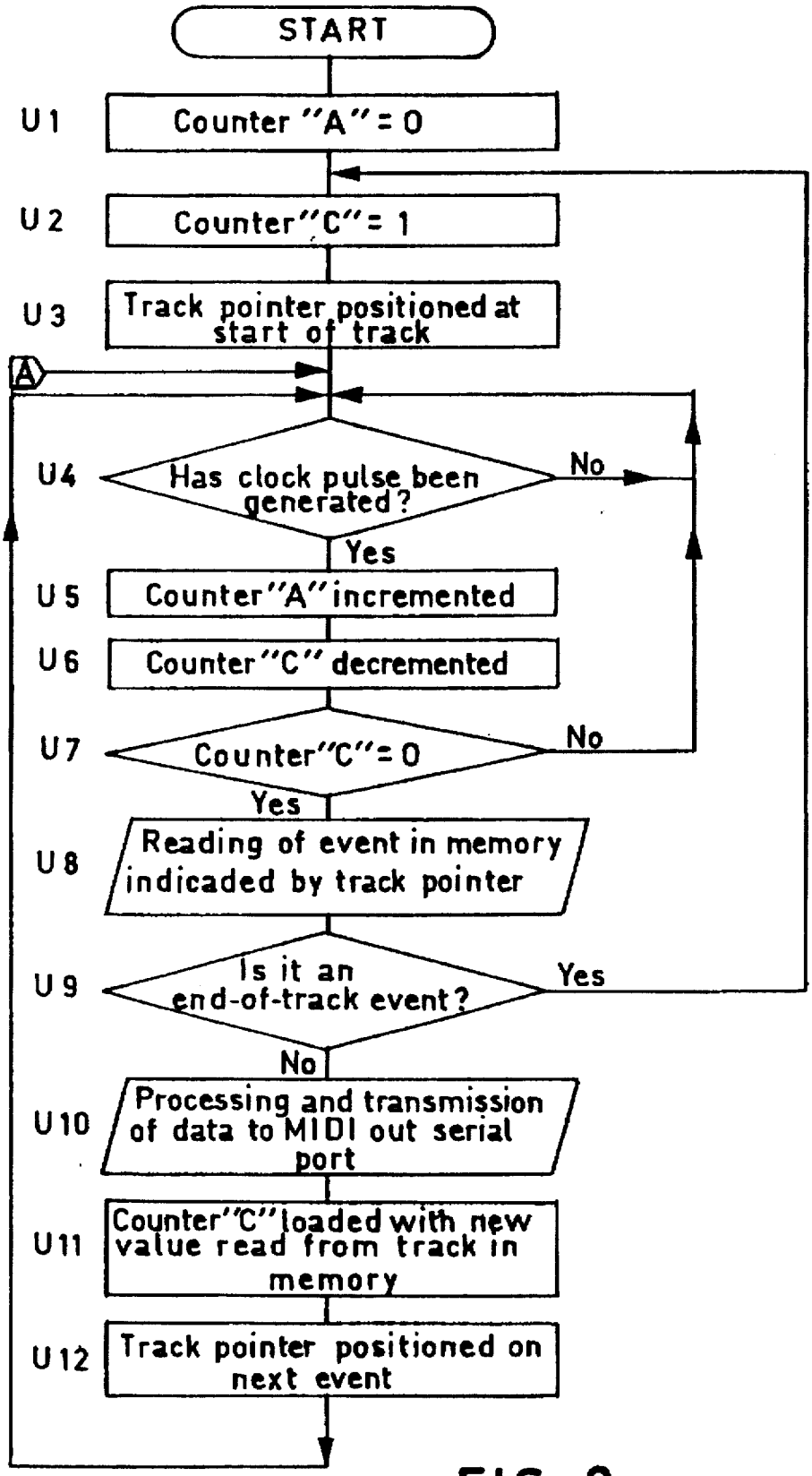
FIG. 8 is a flowchart illustrating the operating mode of the apparatus according to the invention, for reading a track of a pattern in a cyclical mode (loop)

With reference to FIG. 8 we shall now describe the reading of a track of a looped cyclical pattern.

When the procedure start switch is activated on the control panel of the musical data pattern selection block 12, the CPU initializes the following counters: counter A to the value "0" (step U1), while each counter C is set to the value 1 (step U2) so that, at the first decrement of the counter B (step U6), the reading block 11 of the CPU reads the first event of the ROM memory 13B (step U8) and/or of the RAM memory 13A.

The pointer contained in the block 11 is then positioned on the first event of the track of the musical data pattern selected, contained in one of the two memories ROM 13A and/or RAM 13B (step U3).

The CPU waits for a clock signal (CPT) generated by the block 15 (step U4) and, once this signal has been received, the CPU increments the counter A by 1 (step U5) so as to indicate that a time instant corresponding to a CPT has lapsed.

The CPU continues to decrement the counter C and, only when the value "0" is reached (step U7), does the reading block 11 read the next event indicated by its pointer (step US). If the event read is a track-end event (step U9), the CPU returns to the step U2 so as to reposition itself on the first event of the track of the musical data pattern, starting a new read cycle.

If the read event is not a track-end event, the CPU processes and sends it, via Standard MIDI protocol, to the serial port MIDI OUT 17 (step U10) for execution thereof.

The time value contained in the read event, indicating the number of clock signals (CPT) which separates it from the next event, is now entered in the counter C (step U11); at this point the track pointer is positioned on the event following the one already read (step U12).

Figure 9:
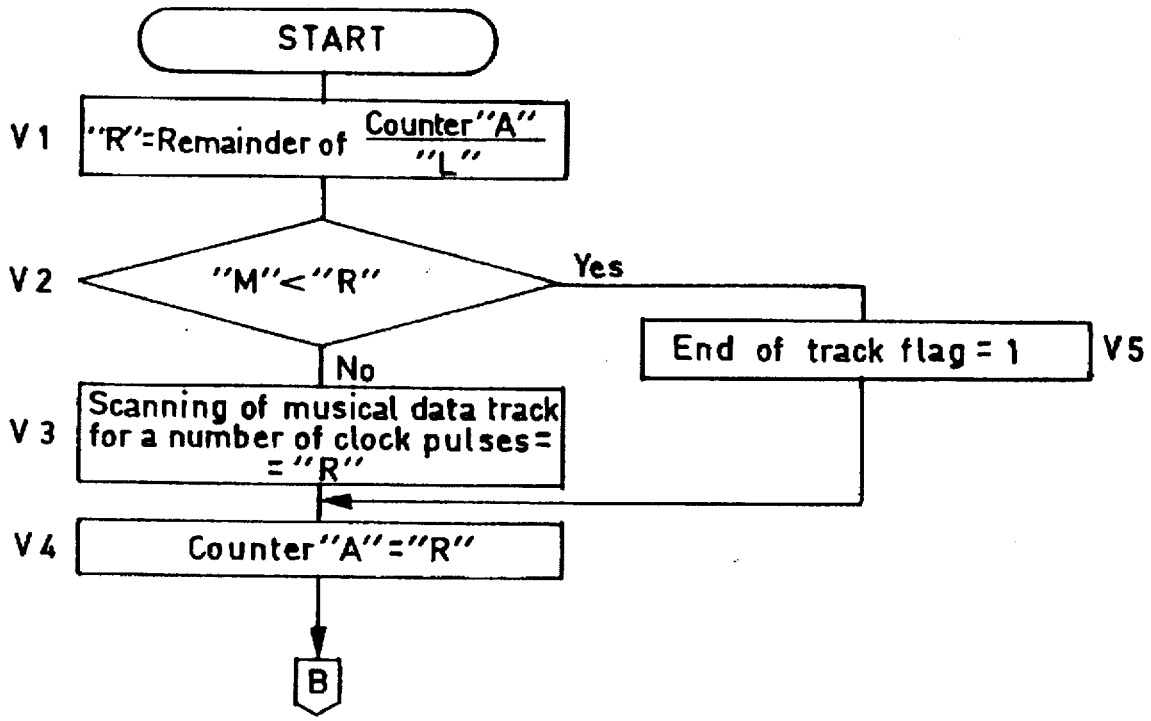
FIG. 9 is a flowchart showing the operating mode of the apparatus in the case of cross-reading of a track of a cyclical pattern and a track of a non-cyclical pattern.

The flowchart in FIG. 9 describes, on the other hand, the transition from reading of a track of a cyclical pattern to a track of a non-cyclical pattern.

When, in a given instant, the block 12 of the musical data pattern selector or the MIDI IN serial port 14 communicates a read address of a track of a non-cyclical data pattern, different from the one currently selected, the CPU 10 synchronizes the transition from one track of a pattern to that of another, calculating for each track the position of the event from where starting the reading of the track in the non-cyclical pattern; in the next step V1, the CPU 10, via its arithmetic calculating unit ALU, divides the number "A" of the clock signals (CPT) which have lapsed from the moment when reading of the pattern is started, by the number "L" of clock signals (CPT) contained in a musical bar. The remainder R of this division is the new value of the counter A in number of clock signals (CPT) which indicates the number of signals (CPT) to be skipped from the start of the cyclical pattern which is read after the non-cyclical one.

If the value of R is greater than the number M of the clock signals (CPT) contained in the entire track of the pattern (step V2), the track-end indicator is set to the value 1 (step V5) so as to indicate that the track-end of the non-cyclical pattern has been reached.

If the value R, on the other hand, is less than or equal to the number M (step V2), the pointer is positioned on the first event of the track of the cyclical pattern and the reading block 11 reads all the events of the track of the pattern until it reaches a number of clock signals (CPT) equal to the value R (step V3).

The value R is then assigned to the counter A (step V4) and execution is continued until step S6 of the flowchart shown in FIG. 7, for reading the track of the non-cyclical pattern (reference B).

Figure 10:
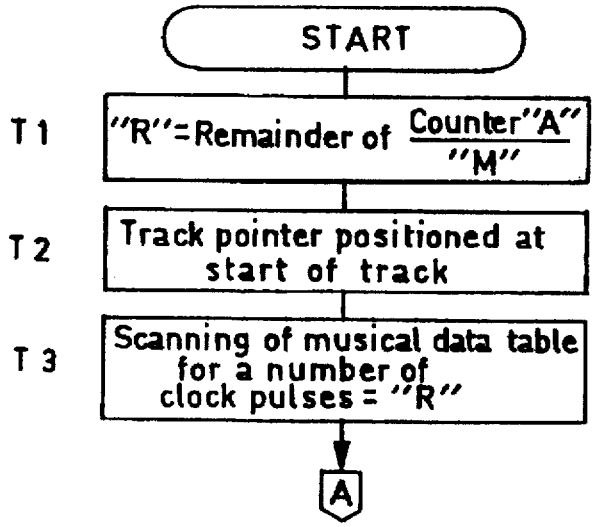
FIG. 10 is a flowchart which shows the method of operation of the apparatus in the case of cross-reading of tracks of cyclical or non-cyclical patterns.

FIG. 10 shows, finally, the flowchart describing the transition from reading of a track of a cyclical pattern to reading of a track of a different cyclical pattern, or a track of a non-cyclical pattern to a track of another non-cyclical pattern.

In this case, when the block 12 of the musical data pattern selector or the MIDI IN serial port 14 communicates a read address of a data pattern, for example of the cyclical type, different from the one previously selected one, the CPU synchronizes the transition between the two patterns, calculating the position of the event from where reading of the new pattern is to be subsequently started.

In step T1, the CPU, by means of its mathematic calculating unit ALU, divides the number of timing signals (CPT) which have lapsed from the starting of the reading, by the number M of clock signals (CPT) contained in the entire track of the pattern. The remainder R of this division is the new value of the counter A expressed as the number of clock pulses which indicate the number of pulses (CPT) to be skipped from the start of reading of the track of the new cyclical pattern.

The pointer is therefore positioned on the first event of the track of the new cyclical pattern (step T2) and the reading block 11 reads all the events of the pattern track until it reaches a number of timing pulses equal to the value R of the remainder (step T3).

At this point, execution can continue up to step U4 (Reference A) in accordance with the flowchart for reading a track of a cyclical pattern, shown in FIG. 8.

What is claimed is:

1. An electronic apparatus for the composition and reproduction of musical data comprising:

memory means for storing a plurality base patterns of musical data, in which each base pattern consists of a set of parallel tracks containing musical data relating to different songs and/or accompaniment styles, and in which said data tracks in each pattern have a same or different lengths which extend over a given number of musical bars;

data pattern selection and control means for selecting and reading the musical data of one or more data tracks in each pattern in said memory means;

as well as program means comprising program instructions for reading and sequentially composing the musical data from different selected patterns and subsequently read from said memory means, said programming means for the composition and reading of the musical data of the selected patterns comprising: control means operative during data reading, for conforming the number of musical bars and the temporal length of the data tracks of shorter length, to the number of musical bars and the lengths of the longest data track in each base pattern, and means for synchronizing reading of the data patterns selected so as to start, in real time, the reading of tracks of equal or different length of a data pattern, from a point comprised in a real part or in a virtual extension of tracks of equal and/or different length of each pattern selected from said memory means, maintaining in a musically consistent condition the musical data read in each selected pattern and the musical data read in a subsequently selected pattern.

2. An apparatus according to claim 1, in which the memory means comprise a plurality of musical patterns relating to a multiplicity of arrangement variations for different styles and/or songs, memorized in two pattern groups, of which one group comprises a first set of pattern divisions, in which the musical data relating to a cyclically repeatable succession of musical events are memorized only once or in a "compacted" form so as to be read and cyclically reproduced, and in which the other group of patterns comprises a second set of pattern divisions formed by a non-cyclical succession of musical events, which are memorized in their total extension and which are read and played once only; and in which each pattern division in turn comprises different musical modes, such as "major", "minor" and "seventh" each one composed of several tracks of equal and/or different length containing the data of musical events relating to various associated instrument groups.

3. An apparatus according to claim 1, in which the data pattern selection and control means comprise an address selecting device for selecting the read addresses of the musical data patterns, and a pointer unit for reading the musical data tracks of the patterns memorized in said memory means; and in which said pattern selection means comprise a MIDI IN port.

4. An apparatus according to claim 3, in which the musical data pattern read unit is connected to means for generating musical tones via a MIDI OUT serial port.

5. An apparatus according to claim 1, comprising counting signal generating means for generating signals for counting the duration and the distances between musical events of the pattern tracks, in which the means for synchronizing reading of the tracks of the selected data patterns comprise an arithmetic calculating unit programmed for performing division of the number of counting signals lapsed from the start of a pattern reading, by the number of counting signals contained in each musical bar of a selected non-cyclical data pattern, or by the number of counting signals contained in the entire track of a selected cyclical pattern, assigning the value of the remainder of this division as the value for a /counting device designed to indicate the number of counting signals to be skipped in order to synchronize the current reading of a data pattern track with the reading of a subsequently selected data pattern track.

6. An apparatus according to claim 1, in which said means for memorizing the musical data patterns comprise a read only memory (ROM) containing pre-memorized data patterns.

7. An apparatus according to claim 1, in which said data pattern memory means comprise a read-and-write memory (RAM) for the composition of new musical data patterns.

8. An electronic musical instrument in combination with an electronic apparatus for the automatic composition and reproduction of data according to claim 1, in which said electronic musical instrument comprises tone generating means for the automatic generation of musical tones connected to said MIDI OUT port.

* * * * *

UNITED STATES PATENT AND TRADEMARK OFFICE

CERTIFICATE OF CORRECTION

PATENT NO. : 5,679,913

DATED : October 21, 1997

INVENTOR(S) : Luigi BRUTI et al.

It is certified that error appears in the above-indentified patent and that said Letters Patent is hereby corrected as shown below:

On the title page, Item [75] Inventors: change the spelling of the surname of the third inventor from "Cucco" to --Cuccu--.

Signed and Sealed this

Twenty-third Day of December, 1997

*Attest:*

*Attesting Officer*

BRUCE LEHMAN

*Commissioner of Patents and Trademarks*